US005233919A

United States Patent [19]

Fecteau et al.

[11] Patent Number: 5,233,919

[45] Date of Patent: Aug. 10, 1993

[54] ANGLE BAR AIR REGULATING DEVICE FOR TURNING A WEB

[75] Inventors: Gilles L. Fecteau, Saco, Me.; Richard E. Breton, Rochester, N.H.

[73] Assignee: Heidelberg Harris GmbH, Heidelberg, Fed. Rep. of Germany

[21] Appl. No.: 900,838

[22] Filed: Jun. 18, 1992

[51] Int. Cl.[5] ..... B41F 13/06

[52] U.S. Cl. ..... 101/228; 226/197

[58] Field of Search ..... 101/228, 219, 220, 221, 101/222, 223, 224, 227, 231, 178, 176; 226/97, 196, 197, 199, 7; 34/156

[56] References Cited

U.S. PATENT DOCUMENTS 3,744,693 7/1973 Greiner ..... 226/97

4,453,465 6/1984 Heller et al. ..... 101/228

FOREIGN PATENT DOCUMENTS 3436870 5/1986 Fed. Rep. of Germany .

*Primary Examiner*—J. Reed Fisher

*Attorney, Agent, or Firm*—Herbert L. Lerner; Laurence A. Greenberg

[57] ABSTRACT

In an angle bar turning a web having an exterior pipe formed with outlet openings, an air regulating device includes a zone tube disposed within and radially spaced from the exterior pipe so as to define an annular space therebetween, structure for dividing the annular space into a plurality of mutually isolated zones in longitudinal direction of the exterior pipe, the zone tube having at least one air outlet opening formed therein in each of the zones for coordination with the outlet openings formed in the exterior pipe, and an air controller tube disposed within the zone tube and being formed in circumferential direction thereof with at least two zonal combinations of outlet openings differing from one another, the air controller tube being turnable about the longitudinal axis thereof within the zone tube.

12 Claims, 2 Drawing Sheets

ANGLE BAR AIR REGULATING DEVICE FOR TURNING A WEB

The invention relates to an angle bar or turn bar charged with blowing air for turning a web, such as an imprinted web, and more particularly, to such an angle bar having an exterior pipe formed with air outlet openings, and an air regulating device for covering those air outlet openings which need not be open for a given web width and/or web guidance or feed.

From German Patent 34 36 870, it has become known to provide a tubular angle bar or turning bar for rotary printing presses for turning a printed paper web. The angle bar, in a semi-cylindrical turning region, is provided with nozzle or jet-like outlet bores for forming an air-cushion underneath the paper web. In order to coordinate the application of the blowing air of the angle bar to the respective web width, longitudinally displaceable pistons are arranged in the hollow space of the angle bar mutually spaced and independent of one another. In order to localize the air cushion precisely underneath the paper web, each piston carries, at an end thereof facing towards the other piston, a sleeve-shaped tongue which is similar in the outer diameter thereof to the piston diameter. The outer end face of this sleeve-shaped tongue is inclined in a manner corresponding to the course of the edge of the turned paper web.

With the angle bar presented in the aforementioned German Patent 34 36 870, the air cushion may be coordinated exactly with the respective width of the paper web. The exact setting of the pistons can only be performed, however, if the angle bar is charged with pressurized or compressed air. In an elaborate and expensive method, dependent upon the piston-setting, operating personnel thus have to examine the escape of air manually. Only in this manner could a determination be made as to whether the air cushion were optimally set for the respective web width with this prior-art device.

In U.S. Pat. No. 4,453,465 an angle bar charged with blowing air is described having the following features: In an exterior pipe having air outlet openings, several inner pipe lengths formed with openings are arranged in axial direction. By turning the inner lengths of pipe, the air outlet openings of the inner pipe lengths can be brought into overlying alignment or covered by the air outlet openings of the exterior pipe. Thus, within a desired region, the blowing air is applied to the angle bar.

In this heretoforeknown construction, the coordination of the air cushion with the respective web width is effected by twisting the individual inner lengths of pipe. Depending upon the respective web width which has to be set, extensive operational effort is needed. Also, with this heretoforeknown arrangement, due to the lack of a suitable scale for the respective zone to which blowing air is being applied, a pre-setting of the angle bar can only be accomplished with pressurized or compressed air, i.e., in this case, as well, the operating personnel have to examine, by hand, whether or not blowing air is being applied to a zonal region of the angle bar.

It is accordingly an object of the invention to provide an angle bar charged with blowing air in which, by one adjusting process, the air cushion is optimally adjustable to specific web widths and/or web guidances or leads.

With the foregoing and other objects in view, there is provided, in accordance with the invention an angle bar turning a web having an exterior pipe formed with outlet openings, an air regulating device comprising a zone tube disposed within and radially spaced from the exterior pipe so as to define an annular space therebetween, means for dividing the annular space into a plurality of mutually isolated zones in longitudinal direction of the exterior pipe, the zone tube having at least one air outlet opening formed therein in each of the zones for coordination with the outlet openings formed in the exterior pipe, and an air controller tube disposed within the zone tube and being formed in circumferential direction thereof with at least two zonal combinations of outlet openings differing from one another, the air controller tube being turnable about the longitudinal axis thereof within the zone tube.

In accordance with another feature of the invention, the zone tube is fixed in position within the exterior pipe.

In accordance with a further feature of the invention, the dividing means comprise a plurality of sealing rings disposed between the exterior pipe and the zone tube. Thus, rubber rings such as O-rings, for example, are distributed about the circumference of the zone tube and simultaneously arrange the space between the exterior pipe and the zone tube into airtight zones which are isolated from one another.

In accordance with an additional feature of the invention, the air controller tube is form-fittingly positioned within and in register with the zone tube. Because the air controller tube is formed with various zonal combinations of air outlet openings distributed over the circumference thereof, blowing air may be applied to the angle bar in the desired regions by simply turning the air controller tube.

In accordance with an added feature of the invention, there is provided a turnable control knob secured to at least one of the ends of the air controller tube and extending out of the respective end of the angle bar.

In accordance with yet another feature of the invention, the control knob is formed with a marking thereon, and a respective end of the exterior pipe is also formed with markings, the control knob being turnable to respective settings wherein the marking of the control knob is aligned with the markings, respectively, of the exterior pipe so as to define given zonal combinations of the air outlet openings of the exterior pipe of the angle bar. If a marking, which is applied to the control knob itself, is aligned with a desired marking at the end face of the angle bar, then the control of a desired combination of air outlet openings is exactly defined. This feature eliminates manual pre-checking of the air outlet openings to which the blowing air has been applied. The pressman instantaneously knows from the setting of the control knob, which combination of air outlet openings has been set at that instant.

To ensure that a desired combination is set exactly, i.e., that the applied air outlet openings of the air controller tube and zone tube are in overlying alignment, in accordance with yet a further feature of the invention, at least one pin is secured at the respective end of the exterior pipe, and the air controller tube is formed at the one end thereof with recesses corresponding to the markings on the respective end of the exterior pipe, the pin being snappable into a respective one of the recesses.

In order to avoid damage to the end face of the air controller tube during turning, this pin, in accordance with yet another feature of the invention, is made of synthetic material, for example, a polymeric amide such is known under the trade name Nylon.

In accordance with still another feature of the invention, the zone tube is formed in an end region thereof with an opening through which the blowing air is feedable to applicable air outlet openings of the angle bar.

In accordance with again an added feature of the invention, control means are provided for turning the air controller tube to a setting corresponding to at least one of a pre-selectable web width and web guide or lead.

With reference to the continuously advancing automatization of printing presses, it is especially advantageous, that the application of blowing air to an angle bar according to the invention be automated in a relatively simple manner.

In accordance with a further feature of the invention, therefore, the control means comprise a servomotor for controlling the turning of the air controller tube automatically. The respective setting of the air controller tube with respect to the zone tube, for example, is defined by means of additional angle information.

In accordance with a concomitant feature of the invention, an area of the air controller tube is formed with no openings and, in one of the settings, is in alignment with the air outlet opening of the zone tube in all of the isolated zones. Other features which are considered as characteristic for the invention are set forth in the appended claims.

Although the invention is illustrated and described herein as embodied in an angle bar air regulating device for turning a web, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, in which.

Figure 1:
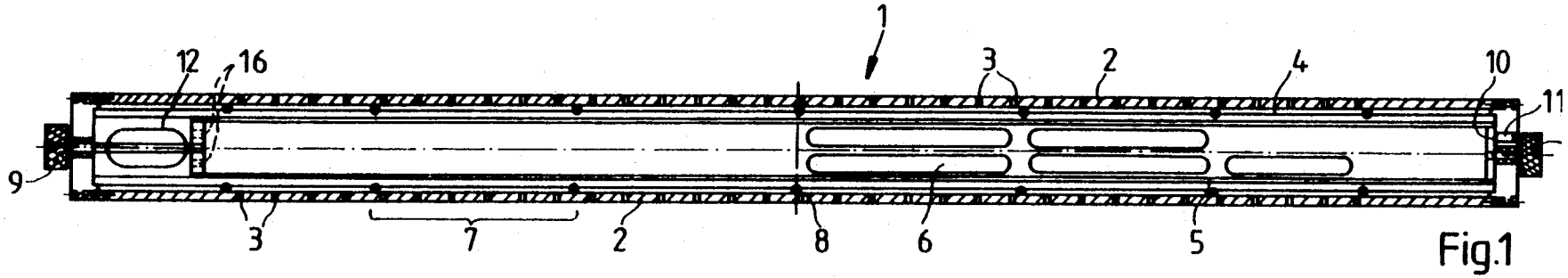
FIG. 1 is a longitudinal sectional view of an angle bar charged with blowing air, according to the invention.

Referring now to the drawings and first, particularly to FIG. 1 thereof, there is shown therein an angle bar charged with blowing air, according to the invention. The angle bar 1 is formed of an exterior pipe 2, which is equipped with air outlet openings or holes 3, a center or zone tube 4 and an inner or air controller tube 5. The zone tube 4, is disposed, with O-rings 8 surrounding it at special intervals, within the exterior pipe 2. These O-rings 8 thus define specific zones 7 in the longitudinal direction of the exterior pipe 2 and zone tube 4 within which one or more holes are located.

Blowing air may be applied within given combinations of the zones 7. In the axial or longitudinal direction of the angle bar, as is clearly shown in FIG. 2, at least one air outlet opening 13 is formed in the zone tube 4, for each of the zones 7 to which, depending upon the radial position of the inner or air controller tube 5, blowing air is or is not applied. The air controller tube 5 is turnable manually by control knobs 9, which are located at the end faces of the air controller tube 5, and extend out from the ends of the angle bar 1 which is charged with blowing air. In order to assure reliable gripping and turning of the control knobs 9, the cylindrical surface of the control knobs 9 can be roughened.

In the embodiment of the angle bar constructed in accordance with the invention, as illustrated in FIG. 1, blowing air is fed into an end region of the center or zone tube 4 through an opening 12 formed therein and enters the air controller tube 5 through end openings 16 formed in the latter.

Figure 2:
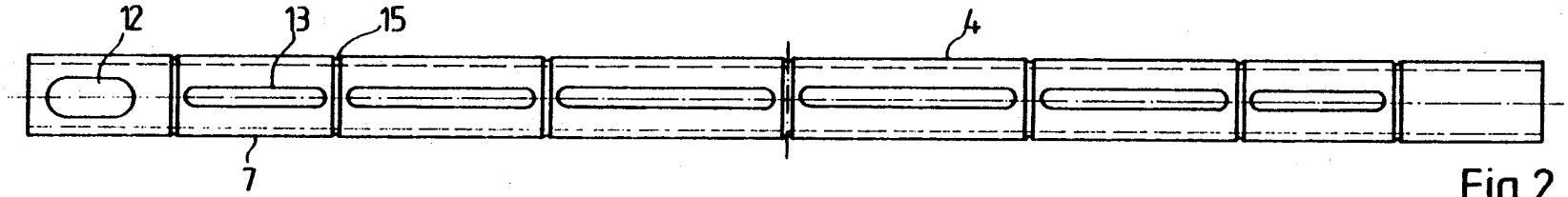
FIG. 2 is a plan view of a center tube or zone tube forming part of the angle bar of FIG. 1.

FIG. 2 is a plan view of the center or zone tube 4. The individual zones 7 are distinguishable from one another by annular grooves 15 which are formed in the outer cylindrical surface of the zone tube 4. Each of the grooves 15 receives therein a rubber ring, such as the aforementioned O-ring 8, especially. The zone tube 4 is accordingly fixedly positioned thereby in the exterior pipe 2 and, furthermore, this constructive arrangement provides airtight isolation of the space formed between and defined by the zone tube 4, the exterior pipe 2 and the respective O-rings 8 of the individual zones 7 when one or more of the air outlet openings 13 of the zone tube 4 is covered by a solid wall portion of the inner air controller tube 5. The blowing air is supplied, as mentioned hereinbefore, through the opening 12 formed in the end region of the zone tube 4 which is always in communication, for example, with an air intake opening formed thereat in the exterior pipe 2.

Figure 3:
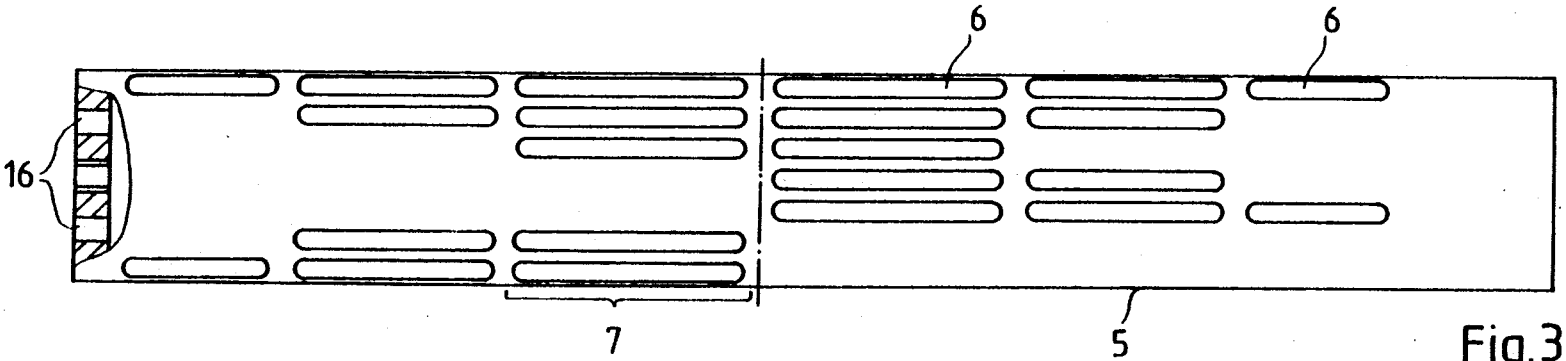
FIG. 3 is an enlarged plan view of a special embodiment of the cylindrical jacket or casing of an inner or air controller tube disposed within the zone tube of the angle bar of FIG. 1.

FIG. 3 is an enlarged plan view of the cylindrical jacket of the air controller tube 5. The latter is divided into six zones 7 in the embodiment of FIG. 3, in each of which one or more air outlet openings 6 are to be found in various combinations. The form and number of these air outlet openings 6 per zone 7 is completely arbitrary. They can be in elongated or slot form, as illustrated in FIG. 3; however, it is indeed possible, that these longitudinal holes or slots may be formed instead as round air outlet openings, for example. It is important only that the form and number of the air outlet openings 6 of the air controller tube 5 and the form and number of the air outlet openings 13 of the zone tube 4 be coordinated with one another for each zone 7 so as to permit a varying amount of air to discharge zonewise from the zone tube 4 through the air outlet openings 13 thereof and through the air outlet openings 6 of the air controller tube 5 into the space between the zone tube 4 and the exterior pipe 2 and, therefrom, out of the holes 3 formed in the exterior pipe 2, or even to block the air from discharging therethrough altogether.

FIG. 3 illustrates a simplified case, wherein, namely, the angle bar 1 charged with blowing air has six zones 7 distributed over the length thereof, in each of the zones 7, the air controller tube 5 having different distributions of the slot like air outlet openings 6, and the fixed zone tube 4 having only one slot-like opening 13.

Figure 4:
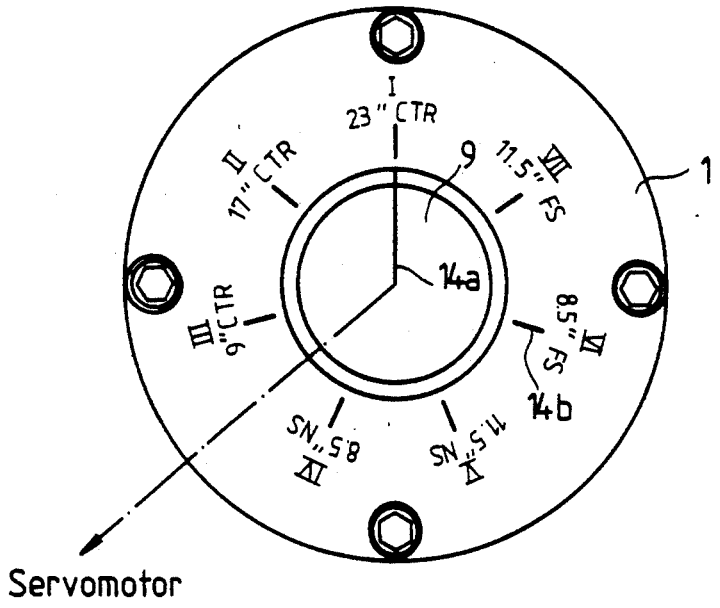
FIG. 4 is an enlarged left-hand end view of the angle bar of FIG. 1 charged with blowing air, according to the invention.

FIG. 4 is an enlarged end view of the angle bar 1 which is charged by blowing air. By means of the turnable control knob 9, the air controller tube 5, which is form-fittingly received in the zone tube 4, as mentioned hereinbefore, can be set into a given angular position with respect to the fixed zone tube 4, and a desired application of blowing air can be set in the angle bar 1. In this regard, a marking 14*a*, for example, on the front of the control knob 9 is coordinated with one of several markings 14*b* provided at the end of the exterior pipe 2 of the angle bar 1. In order to ensure that a desired position is set exactly, i.e. that the air outlet openings 6 of the air controller tube 5 are covered by or in overlying alignment with the air outlet openings 13 of the zone tube 4, on the interior end face of the exterior pipe 2, a spring-action pin 11 such as a nylon ball plunger, for example, snaps into one of a number of recesses 10 formed at the end of the air controller tube 5. The recesses 10 are located in positions which correspond to the markings 14*b* on the end face of the angle bar 1.

The knob 9 is shown located at each end of the air controller tube so as to permit relatively easy access from either end of the angle bar 1, and flexibility with respect to changes in angular web direction. The markings would be duplicated on the opposite end, but would reflect differences in "near-side" and "far-side" designations.

When an optimal overlying alignment of the air outlet openings 6 formed in the air controller tube 5 and the air outlet openings 13 formed in the zone tube 4 occurs, the pin 11 thus snaps into the respective recess 10 formed at the end face of the air controller tube 5 in accordance with the respective marking 14*b*.

Referring further to FIG. 4, if the air controller tube 5 is turned with respect to the zone tube 4 to the setting represented in the figure, wherein the marking 14*a* is aligned with the marking 14*b* located at the position I, then the angle bar 1 charged with blowing air is completely enveloped with blowing air over the entire length thereof. This configuration is selected when the web is of maximum width. If the web is narrower in width, yet travels midway over the angle bar 1, then the settings II and III, respectively, are selected. By thus covering the outer regions of the angle bar 1 to which blowing air has been applied, the unnecessary loss of blowing air applied to unused air outlet openings 2 when a narrow web is being guided is presented. The additional settings IV and V as well as VI and VII, respectively, are then of advantage if a narrower web is to be guided at the right-hand and at the left-hand sides, respectively, of the angle bar 1 to which blowing air has been applied.

Of course, a setting may be provided for wherein an area of the air controller tube 5 having no openings 6 therein, for each of the zones 7, is located in alignment with the respective air outlet openings 13 of the fixed zone tube 4 so that air flow through all of the holes 3 of the exterior pipe 2 is effectively shut off thereby without having to use an external shut-off valve.

The subdivision of the length of the angle bar 1 charged with blowing air into individual zones 7 is, of course, at random. The smaller the individual zones 7 are constructed, the more optimal is the coordination of the blowing-air consumption with the respective guided web.

We claim:

1. In an angle bar turning a web having an exterior pipe formed with outlet openings, an air regulating device comprising a zone tube disposed within and radially spaced from the exterior pipe so as to define an annular space therebetween, means for dividing said annular space into a plurality of mutually isolated zones in longitudinal direction of the exterior pipe, said zone tube having at least one air outlet opening formed therein in each of said zones for coordination with the outlet openings formed in the exterior pipe, and an air controller tube disposed within said zone tube and being formed in circumferential direction thereof with at least two zonal combinations of outlet openings differing from one another, said air controller tube being turnable about the longitudinal axis thereof within said zone tube.

2. Angle bar air regulating device according to claim 1, wherein said zone tube is fixed in position within the exterior pipe.

3. Angle bar air regulating device according to claim 1, wherein said dividing means comprise a plurality of sealing rings disposed between the exterior pipe and said zone tube.

4. Angle bar air regulating device according to claim 1, wherein said air controller tube is form-fittingly positioned within and in register with said zone tube.

5. Angle bar air regulating device according to claim 1, including a turnable control knob secured to at least one of the ends of said air controller tube and extending out of the respective end of the angle bar.

6. Angle bar air regulating device according to claim 5, wherein said control knob is formed with a marking thereon, and a respective end of the exterior pipe is also formed with markings, said control knob being turnable to respective settings wherein said marking of said control knob is aligned with said markings, respectively, of the exterior pipe so as to define given zonal combinations of the air outlet openings of the exterior pipe of the angle bar.

7. Angle bar air regulating device according to claim 6, wherein at least one pin is secured at one of the ends of the exterior pipe, and said air controller tube is formed at said one end thereof with recesses corresponding to said markings on said one end of the exterior pipe, said pin being snappable into a respective one of said recesses.

8. Angle bar air regulating device according to claim 7, wherein said pin is formed of synthetic material.

9. Angle bar air regulating device, according to claim 1, wherein said zone tube is formed in an end region thereof with an opening through which the blowing air is feedable to applicable air outlet openings of the angle bar.

10. Angle bar air regulating device according to claim 1, including control means for turning said air controller tube to a setting corresponding to at least one of a pre-selectable web width and web guide.

11. Angle bar air regulating device according to claim 10, wherein said control means comprise a servomotor for controlling the turning of said air controller tube automatically.

12. Angle bar air regulating device according to claim 6, wherein, in one of said settings, an area of said air controller tube having no openings formed therein is in alignment with said air outlet opening of said zone tube in all of said isolated zones.

* * * * *